United States Patent [19]

DePrey et al.

[11] Patent Number: 4,742,795

[45] Date of Patent: May 10, 1988

[54] STERN GATE FOR A BOAT HULL

[75] Inventors: James P. DePrey; Brian J. Cornell, both of Green Bay; Niels H. Skjerbek, Marinette, all of Wis.

[73] Assignee: Cruisers Incorporated, Oconto, Wis.

[21] Appl. No.: 268

[22] Filed: Jan. 2, 1987

[51] Int. Cl.[4] ..... B63B 17/00

[52] U.S. Cl. ..... 114/362; 114/343; 182/91; 182/164

[58] Field of Search ..... 114/362, 343, 364, 259, 114/344; 248/641, 642; D12/203, 300, 315, 317, 318; 182/91, 164

[56] References Cited

U.S. PATENT DOCUMENTS

| | | | |
|---|---|---|---|
| D. 242,848 | 12/1976 | Morrison et al. | D12/70 |
| D. 242,925 | 1/1977 | Salter | D25/64 |
| D. 280,094 | 8/1985 | Riviezzo | D12/318 |
| 2,347,412 | 4/1944 | Higgins | 114/259 |
| 2,558,975 | 7/1951 | Moreno et al. | 114/65 |
| 3,539,033 | 11/1970 | Schwarz et al. | 182/77 |
| 3,763,810 | 10/1973 | Payne | D12/300 X |
| 3,804,200 | 4/1974 | Sandberg | 182/91 |
| 3,883,910 | 5/1975 | Naylor, III | 9/6 |
| 4,191,388 | 3/1980 | Barksdale | 182/91 X |
| 4,293,967 | 10/1981 | Ord | 9/1.6 |
| 4,457,391 | 7/1984 | Marques | 182/164 |
| 4,541,507 | 9/1985 | Gibellato | 182/86 |

FOREIGN PATENT DOCUMENTS

| | | | |
|---|---|---|---|
| 1077096 | 3/1960 | Fed. Rep. of Germany | 114/362 |
| 2821172 | 11/1978 | Fed. Rep. of Germany | 114/362 |
| 2235040 | 1/1975 | France | 114/362 |
| 2438578 | 6/1980 | France | 114/362 |
| 55-127286 | 10/1980 | Japan . | |
| 1585865 | 3/1981 | United Kingdom . | |

OTHER PUBLICATIONS

Glastron Company Advertisement, "V-214 Vagabond Camper", 3/1969.

Applicants' U.S. patent application Ser. No. 913, filed Jan. 2, 1987, for "Boat Stern".

1986 Chris Craft Cruisers catalog, dated 1985.

Cruiser's Incorporated Sportfishing Machines catalog, dated 1985.

Cruiser's Incorporated catalog, dated 1985.

*Primary Examiner*—Galen Barefoot

*Assistant Examiner*—Paul E. Salmon

*Attorney, Agent, or Firm*—Quarles & Brady

[57] ABSTRACT

A hull for a boat includes a lower hull having a bottom below a static waterline and freeboard sides above the waterline. An aft passenger cockpit has a floor above the waterline and a lower stern extends across the rear of the lower hull at least partially below the waterline and is adjoined with the bottom and freeboard sides. An upper stern extends aft of the lower stern at least partially above the waterline and defines a passageway therethrough from the passenger cockpit to aft of the hull. A gate is provided aft of the passenger cockpit in the passageway and hinges connect the gate to the boat to pivot about a horizontal axis. The gate is pivotable from an open position in which it is folded down horizontally where it provides access to the cockpit from aft of the hull to a closed position in which the gate is folded up to close off the passageway and form an inside wall of the passenger cockpit. Thereby, the boat can be backed up to a dock for easy boarding or unboarding. The gate also provides a swim platform for easy access to the water and reboarding from the water.

25 Claims, 4 Drawing Sheets

32
93
6
86
87
37
68
70
76
66
77
74
78
72
69
79
64
56
59
34
27
49
49
54
42
43
52
53
50
44
89
47
92
45

37
70
68
76
74
72
69
82
73
77
79
78
87
5
5
81
86
66
61
64
32
84
63

STERN GATE FOR A BOAT HULL

TECHNICAL FIELD

This invention relates to boat hulls in general, and more specifically to a stern gate adapted to facilitate access or egress to a pleasure boat through the transom or stern section thereof.

BACKGROUND OF THE INVENTION

For centuries, people have been boarding and unboarding boats from a dock by climbing over the gunnels or the stern. Boarding has usually required stepping from the dock to the deck over the gunnel or stern and then down to the floor of the boat and unboarding has required generally the same movements but in reverse. However, the deck in this area is not very well suited to stepping on, as it is often slippery, narrow, and not flat. In addition, because the deck over the gunnels or stern is usually high out of the water, rocking of the boat is amplified in this area. Moreover, it is usually a big step down or up between the deck and dock and between the deck and floor which can be difficult for all but the most physically fit.

Boarding and unboarding a boat from the water has also been a problem, especially for high-sided boats. In some boats, a platform is provided attached to the gunnel or stern outside of the boat which is low to the water for easy access by a swimmer from the water. Where such platforms are not provided, a swimmer must enter the water from the deck and hoist himself or herself up over the deck, sometimes with the help of a ladder, to reboard. In either case, boarding or unboarding requires climbing over the stern or gunnels. Therefore, it is clear that a need exists for a boat that can be easily boarded and unboarded.

SUMMARY OF THE INVENTION

The invention provides a hull for a boat which includes a lower hull having a bottom below a static waterline and freeboard sides above the waterline. An aft passenger cockpit has a floor above the waterline and a lower stern extends across the rear of the lower hull at least partially below the waterline and is adjoined with the bottom and freeboard sides. An upper stern extends aft of the lower stern at least partially above the waterline and defines a passageway therethrough from the passenger cockpit to aft of the hull. A gate is provided aft of the passenger cockpit in the passageway and hinge means connect the gate to the boat to pivot about a horizontal axis. The gate is pivotable from an open position in which it is folded down horizontally where it provides access to the cockpit from aft of the hull to a closed position in which the gate is folded up to close off the passageway and form an inside wall of the passenger cockpit. Thereby, the boat can be backed up to a dock for easy boarding or unboarding. The gate also provides a swim platform for easy access to the water and reboarding from the water.

In a preferred form, the gate is hinged to the hull in the lower forward area of the passageway so that the gate pivots toward the front of the boat from the open position to the closed position. Means are also provided for damping pivotal movements of the gate, preferably including at least one gas cylinder connected to the hinge means behind a side wall of the passageway.

In another aspect of the invention, the gate defines a compartment and a ladder is connected to the gate and stored inside the compartment with a door closing off the compartment. The ladder is deployable into the water from the compartment when the gate is in the open position to further ease reboarding from the water. In the preferred form, the ladder is pivotally connected to the gate and has a plurality of rungs pivotally connected to one another to fold one within another and fit in the compartment. Means are also preferably provided for limiting the rotation of at least one of the lower rungs relative to the next higher rung to prevent the ladder from folding away from a user.

Preferably, means are provided for locking the gate in the closed position and sensor means indicate whether the gate is securely locked. The sensor means preferably includes a first detector to sense the position of the locking means and a second detector to sense the position of the gate. In this way, if either the locking means or the gate is not in a position indicating the gate is securely closed, an appropriate audible or visual warning signal can be given to the boat operator before getting under way.

In yet another aspect, the upper stern includes port and starboard side portions with each portion being defined by a forward wall, a side wall, a rear wall and the adjacent freeboard side. The side walls of the side portions are spaced apart to define the passageway therebetween. The side portions define hollow spaces in which the hardware associated with the hinge means, damping means, locking means and sensor means can be housed out of sight and with easy access for assembly and maintenance.

It is a principal object of the invention to provide a hull for a boat which provides for easy boarding and unboarding of a pleasure boat from or to a dock or the water.

It is another object of the invention to provide a means for easy boarding and unboarding of a boat which can be provided practically and economically in a pleasure boat.

It is another object of the invention to provide a stern gate in a pleasure boat for providing such easy boarding and unboarding.

It is another object of the invention to provide a stern gate including a storable boarding ladder which can be deployed into the water from the gate.

It is another object of the invention to provide a particular stern configuration of a pleasure boat hull for providing such easy boarding and unboarding.

These and other objects and advantages of the invention will become apparent from the drawings and the detailed description.

DETAILED DESCRIPTION OF THE PREFERRED EMBODIMENT

Figure 1:
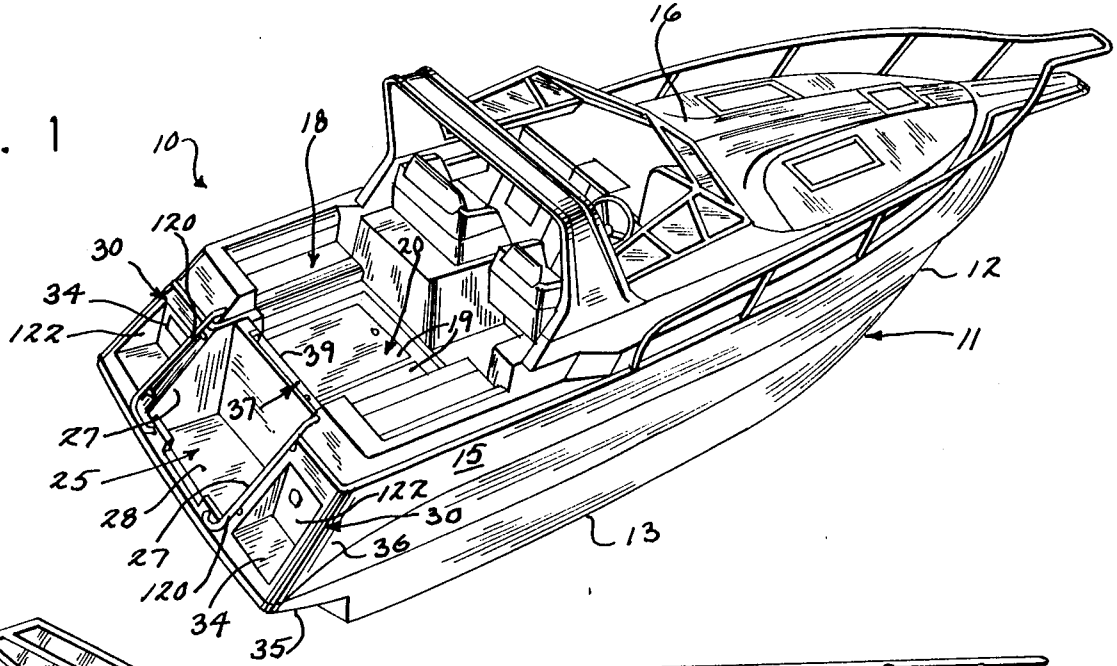
FIG. 1 is a rear perspective view of a boat incorporating a stern gate of the invention with the stern gate in a closed position.
Figure 2:
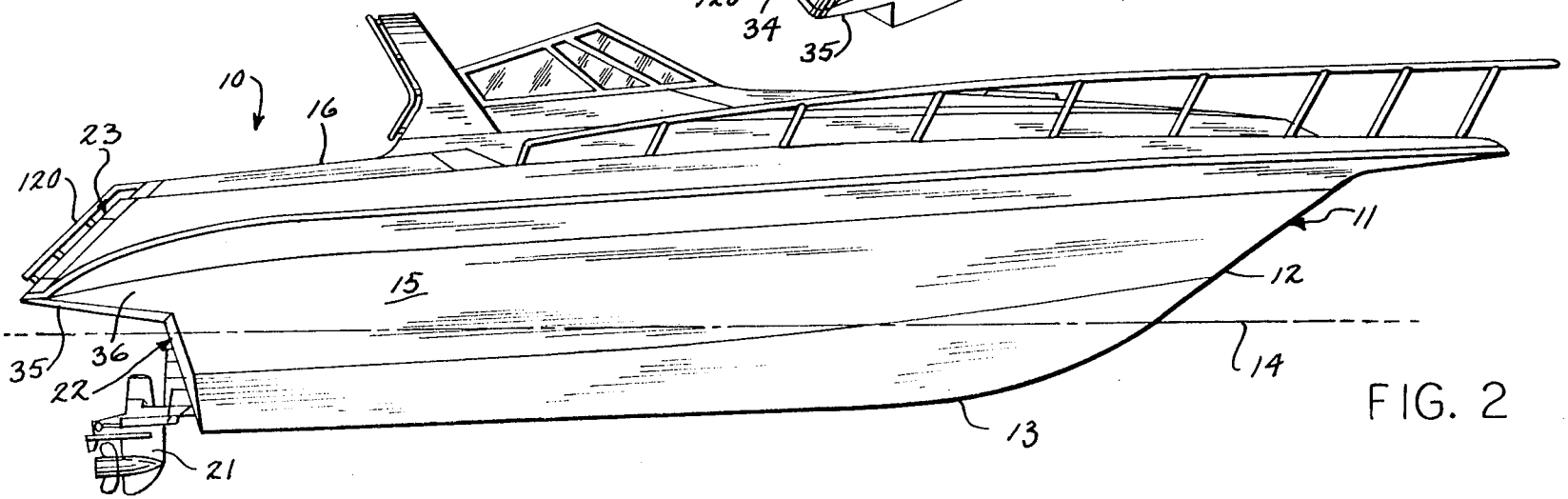
FIG. 2 is a side profile view of the boat of FIG. 1.

Referring to FIG. 1, a boat hull 10 incorporating a stern gate of the invention is shown. The hull 10 of the preferred embodiment is molded fiberglass and has a lower hull 11 with a forward bow 12, a bottom 13 below a static waterline 14 (FIG. 2), and freeboard sides 15 above the waterline. The upper surface of the hull 10 includes a deck 16 and the lower hull 11 and deck 16 enclose a cabin. Rearward or aft of the cabin is a passenger cockpit 18 where a control panel for an operator and seating for passengers is provided. Also, a pair of doors 19 are provided in a floor 20 of the passenger cockpit 18 for access to port and starboard engines located in an engine compartment beneath the floor. A stern drive lower unit 21 to power the boat with the starboard engine is shown in FIG. 2.

Aft of the passenger cockpit 18, the stern or rearward area of the hull 10 includes a lower stern or transom 22 which is molded as part of the lower hull 11 and an upper stern 23. The transom 22 mounts the stern drive lower units and extends partially below the waterline. The upper stern 23 extends from the passenger cockpit 18 aft of and above the transom 22 to the rear end of the hull 10.

The upper stern 23 defines a passageway 25 therethrough rearwardly from the passenger cockpit 18 to aft of the hull 10. The passageway 25 is flanked on each side by substantially vertical sidewalls 27 and has a floor 28. Outwardly from the walls 27, each side portion 30 of the upper stern 23 encloses a hollow space 31 (FIGS. 4 and 5) bordered by the adjacent wall 27, a front wall 32 (FIG. 4), a rear wall 34, a bottom wall 35 (FIG. 2) which extends across and beneath the upper stern and may be integral with the freeboard sides and transom, and the rearmost portion 36 of the adjacent freeboard side 15.

Figure 3:
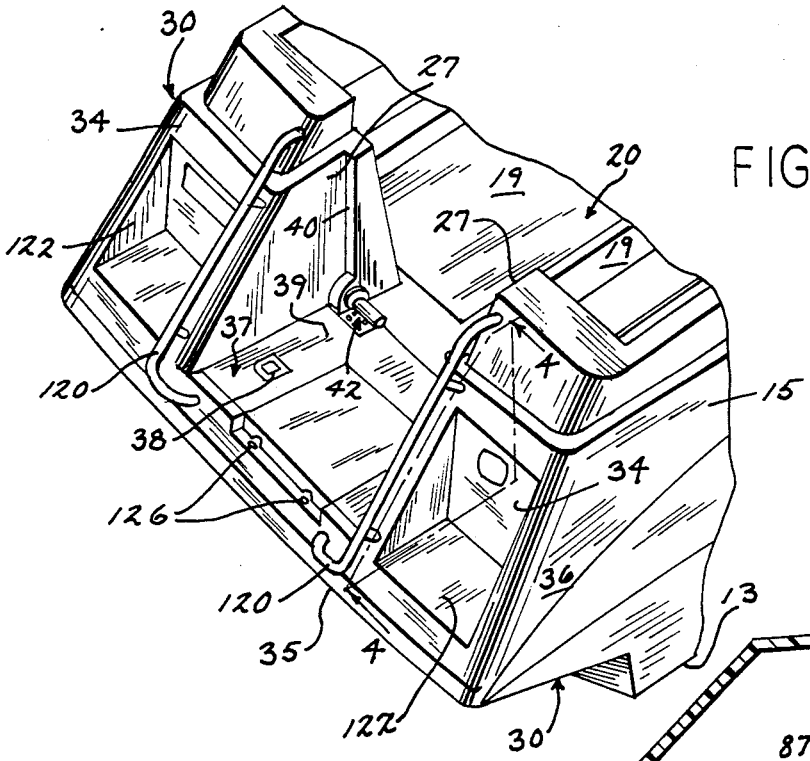
FIG. 3 is a perspective view of the rear portion of the boat of FIG. 1 illustrating the stern gate in an open position.

A gate 37 is hinged to the hull 10 to pivot about a horizontal axis which is transverse to the passageway 25 and is positioned in the lower forward area of the passageway. When the gate is folded up in a closed position, as shown in Fig. 1, the gate closes off the passageway and forms an inside wall of the passenger cockpit 18. This is the position the gate is normally in when the boat is under way. When the gate is folded down, as shown in FIG. 3, it is in a horizontal position with an upper surface 39 substantially flush with the cockpit floor 20 to provide access to the cockpit 18 from aft of the hull 10. This position allows easy unboarding or boarding over the gate whether to or from a dock or the water. A foldable handle 38 is recessed in the upper surface 39 to facilitate grasping the gate to move it into the closed position.

The floor 28 of the passageway 25 is recessed below the level of the cockpit floor 20 by approximately the thickness of the gate 37 to receive the gate in the open position with the upper surface 39 of the gate flush with the cockpit floor 20. Stop ribs 40 are molded or otherwise provided along the forward edge of each side wall 27 to close the gate 37 against. It is noted that in the closed position the gate 37 slants slightly forwardly to allow for draft in molding the stop ribs 40.

Figure 4:
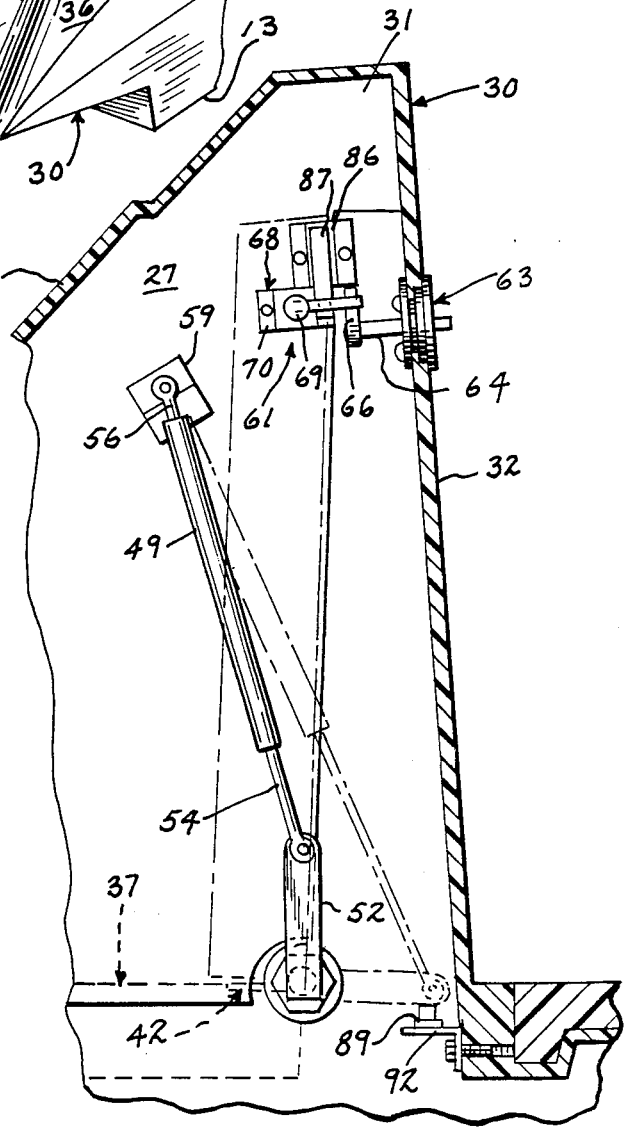
FIG. 4 is a sectional view taken from the plane indicated by the arrows 4—4 of FIG. 3.
Figure 5:
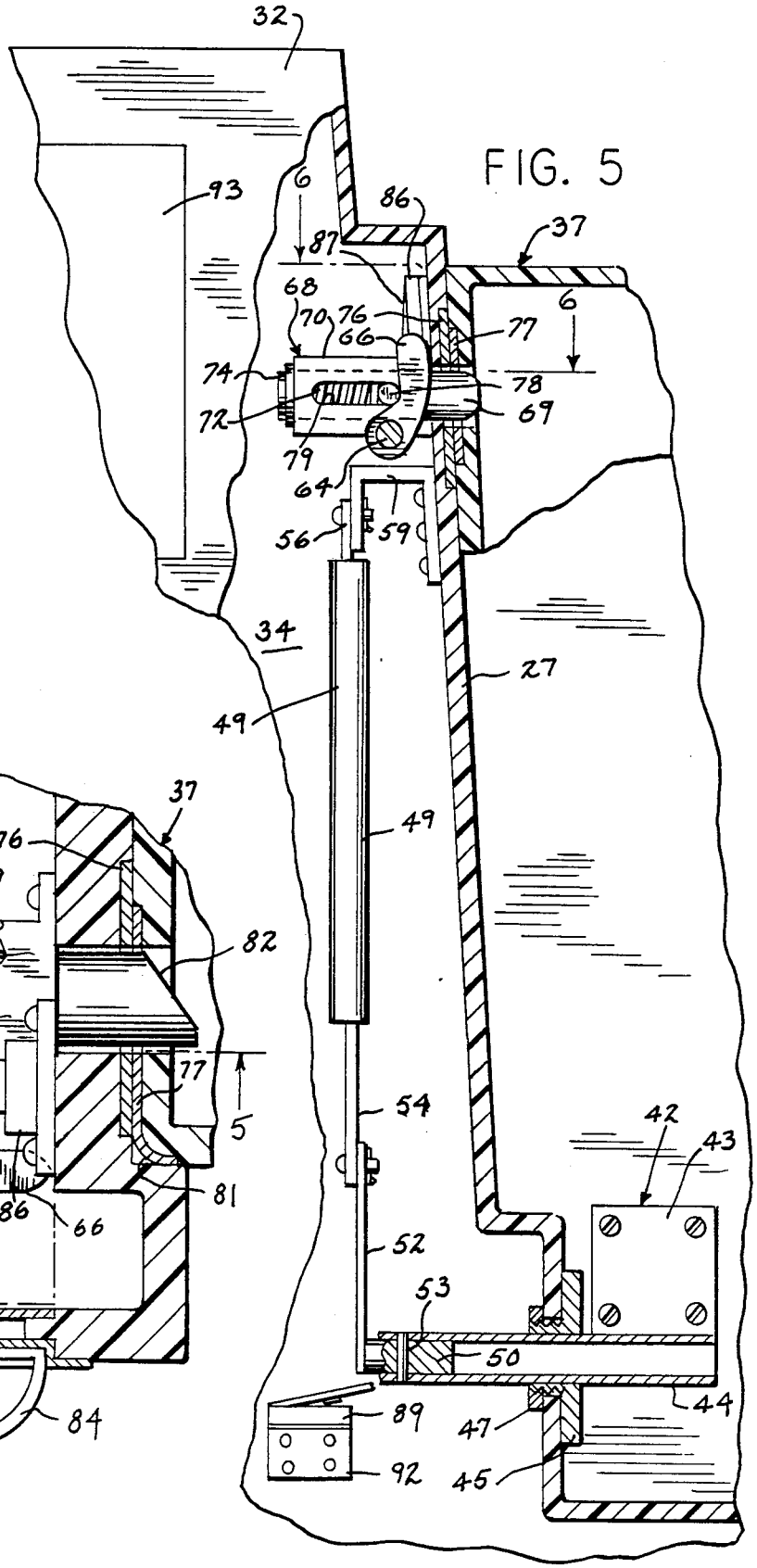
FIG. 5 is a sectional view taken from the plane of the line 5—5 of FIG. 6.
Figure 6:
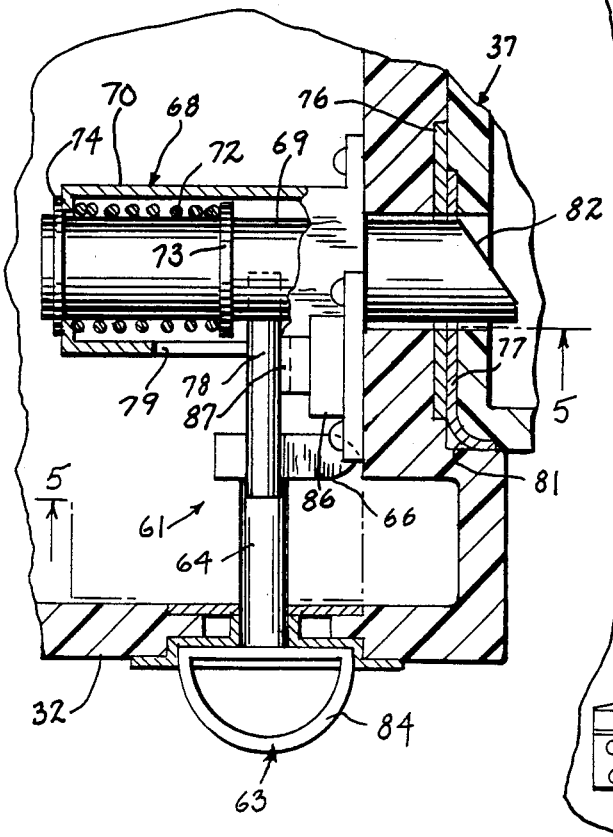
FIG. 6 is a sectional view taken from the plane of the line 6—6 of FIG. 5.

Referring to FIGS. 4 and 5, the gate 37 has a hinge bracket 42 recessed at each of its lower, inside corners ("lower" and "inside" referring to the gate in the closed position). Each bracket 42 consists of a plate 43 which is bolted or otherwise securely mounted to the gate 37 and a tubular hinge post 44 integral with the plate 43. A bushing 45 extends through each of the side walls 27 at the base of the stop ribs 40, which is molded to accomodate the bushings, adjacent to the hinge brackets 42 and is secured to the adjacent wall 27 by a nut 47. Each hinge post 44 extends through one of the bushings 45 to hingedly connect the gate 37 to the hull 10.

To damp swinging of the gate 37, a gas cylinder 49 is provided behind each wall 27 connected to the gate 37. Referring to FIG. 5, a shank 50 of a lever arm 52 is inserted into the hinge post 44 and secured against relative rotation thereto by a pin 53. The end of the lever arm 52 is pinned for relative rotation to a piston end 54 of the gas cylinder 49. A cylinder end 56 of the gas cylinder 49 is pinned for rotation to an U-shaped mounting bracket 59 which is secured to the inside of the wall 27.

Referring to FIG. 4, when the gate 37 is in the closed position, the gas cylinder 49 and lever arm 52 are in the positions shown in phantom. When the gate 37 is in the open position, the gas cylinder 49 and lever arm 52 are in the positions shown in solid lines. Hence, as the gate 37 is swung, the gas cylinder 49 is stroked to resist swinging of the gate 37. This is especially useful when moving the gate from the closed to the open position.

To secure the gate 37 in the closed position, a latch mechanism 61 is provided on the starboard side of the passageway. A handle assembly 63 is bushed in the forward wall 32 of the starboard side portion 30 and has a shank 64 which extends rearwardly and terminates in a cam 66. A latch assembly 68 includes a latch bolt 69 and a housing 70. The housing 70 is secured to the inside of the starboard wall 27 and the bolt 69 is received in a bore through the end of the housing. A compression spring 72 acts between the housing 70 and a spring clip 73 secured to the bolt and a second spring clip 74 on the end of the bolt captures the bolt in the housing. The bolt 69 extends through the starboard wall 27, through a wear plate 76 secured to the wall and into engagement with a latch receiving plate 77 on the starboard edge of the gate 37. The bolt 69 also has a leg 78 which extends through a slot 79 in the housing 70 to follow the cam 66 of the latch handle assembly. When the gate 37 is closed, a forward curved surface 81 of the latch receiving plate 77 engages a rearwardly inclined surface 82 of the bolt 69 to slide the bolt further starboardly against the compression spring 72 until the bolt enters the receiving plate 77 and the gate 37 to secure the gate 37 in the closed position. The bolt 69 is released by rotating a handle 84 of the latch assembly 68 to move the bolt out of the receiving plate 77 against the compression spring 72 at which time the gate 37 can be swung open.

Figure 7:
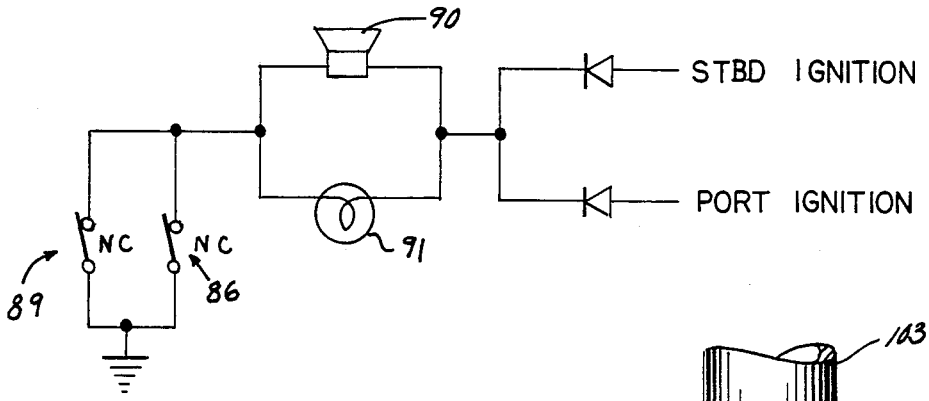
FIG. 7 is a schematic view of a circuit diagram for a sensor system for a stern gate of the invention.

Sensor switches are provided to detect whether the gate 37 is closed and to provide an appropriate signal to the boat operator before getting under way if the gate 37 is not closed. A first switch 86 senses the position of the latch bolt 69. Switch 86 has an actuator 87 which is tripped by the leg 78 of the bolt 69 when the bolt is in its most extended position and acts to open the switch 86 in that position. A second switch 89 mounted on a bracket 92 secured to the wall 32 of the starboard stern portion senses the position of the lever arm 52. Switch 89 is actuated open when the lever arm 52 is in the angular position shown in phantom in FIG. 4 such that the gate 37 is closed. Referring to FIG. 7, it can be seen that if the ignition of either the starboard engine or the port engine is on, and either of the switches 86 or 89 is closed (not actuated), a buzzer 90 and a warning light 91 located in the operator's instrument control panel will be energized. Referring to FIG. 5, it is noted that access to the hollow spaces 31, and therefore to the latch mechanism, the damping cylinders, and the associated hardware, is through a cut out 93 in the forward walls 32 of the stern. In practice, these cut outs are covered with drink wells (not shown) which seal off the hollow spaces 31 and hold cans or other containers for the convenience of the passengers.

Figure 8:
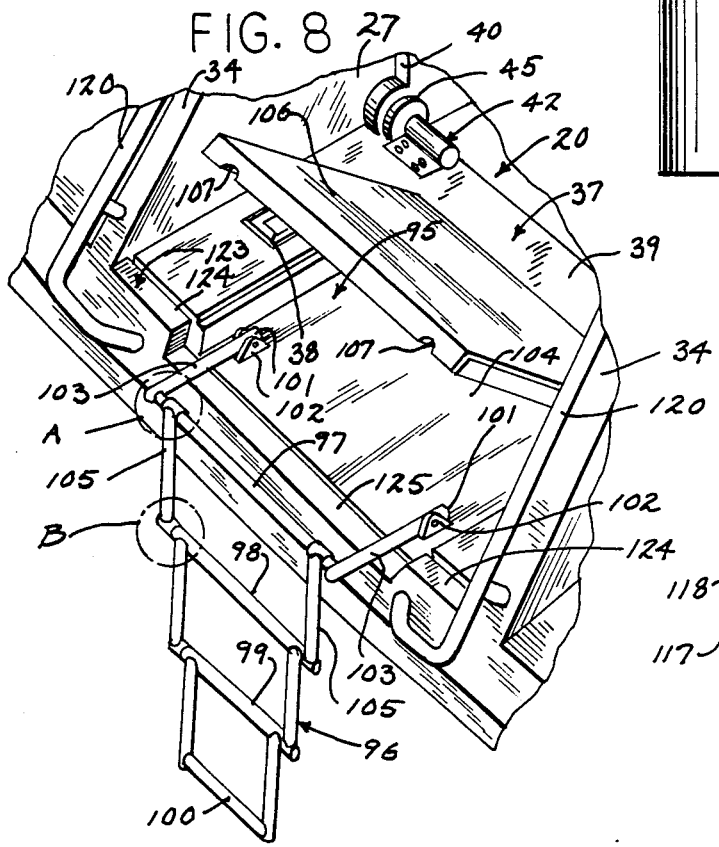
FIG. 8 is a perspective view similar to FIG. 3 but showing a boarding ladder deployed.

Referring to FIG. 8, the gate 37 defines a compartment 95 which normally houses a foldable ladder 96. The ladder 96 can be unfolded from the compartment 95 as shown in FIG. 8 and deployed into the water to ease reboarding from the water. The ladder has four rungs 97, 98, 99 and 100, the top three of which become progressively narrower in the downward direction. The upper ends 101 of ladder sides 103 are hinged to brackets 102 which are secured to the floor 104 of the compartment 95. A door 106 is hinged to the gate along its lower or forward edge to close off the compartment and suitable means are provided (not shown) to keep the door 106 closed when the boat is under way. The rearward or upper edge of the door 106 has semicircular cut outs 107 so that the door can be closed with the ladder 96 deployed to provide a reboarding or swim platform.

Figure 9:
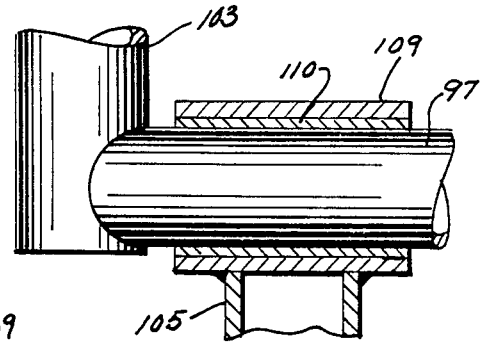
FIG. 9 is a sectional view of a portion of the ladder shown in FIG. 8.

Joints A between the top rung 97 and the ladder sides 103 shown in FIG. 8 are identical and are shown in detail in FIG. 9. In this type of joint, rung 97 is welded to the sides 103 and extends through collars 109 which are welded to adjacent lower sides 105 of the ladder 96. A bushing 110 between the top rung 97 and each collar 109 allows pivoting of the lower portions of the ladder 96 about the top rung 97.

Figure 11:
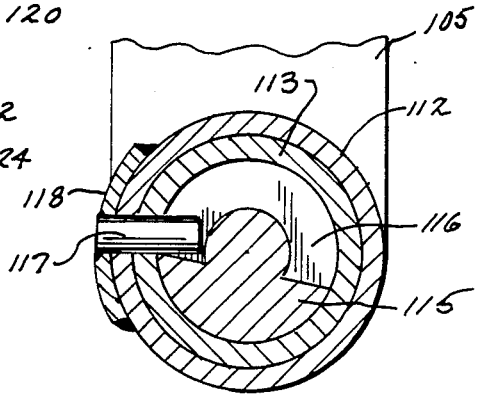
FIG. 11 is a sectional view taken from the plane of the line 11—11 of FIG. 10.
Figure 10:
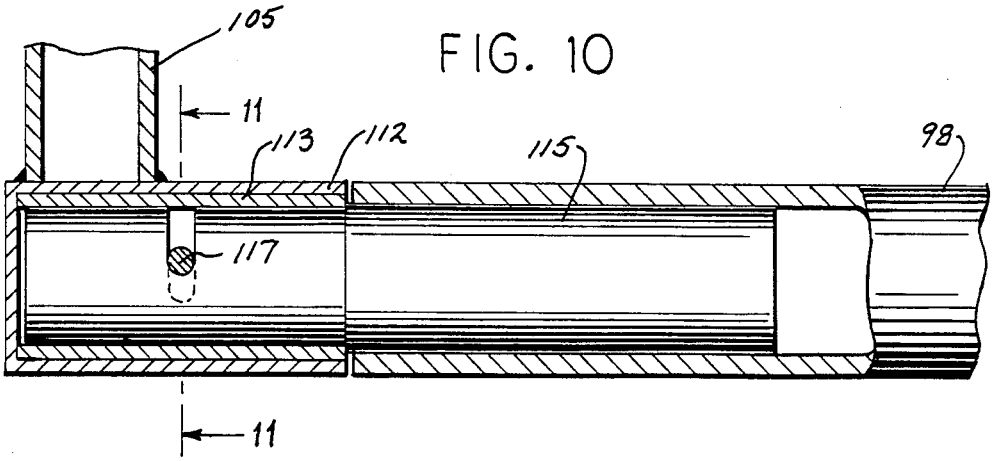
FIG. 10 is a sectional view of another portion of the ladder shown in FIG. 8 taken looking rearwardly.

Joints B, which are the four joints below the top joints A, are shown in detail in FIGS. 10 and 11. In these joints, a tubular cap 112 is welded to the lower end of the side of the ladder immediately above the joint. The cap 112 is lined with a bushing 113 and a solid rod 115 is journaled in the bushing. The rod 115 is pressed into or otherwise secured to the adjacent rung and has a circumferential groove 116 machined into somewhat more than 180° of its upper periphery inside the bushing. A locking pin 117 extends through the front ("front" referring to when the ladder is deployed) of the cap 112 and bushing 113 into the groove 116 and is reinforced by a washer 118 welded onto the outside of the cap. These joints prevent the rungs 98, 99 and 100 of the ladder from folding away from a user when reboarding from the water and allow the ladder to be folded up into the compartment.

It is noted that the floor 28 of the passageway 25 is raised adjacent to its rear edge at 123. The end portions 124 of the raised portion 123 are at the level of the upper surface of the gate 37 and the center portion 125 of the raised portion 123 is approximately at the level that the sides 103 of the ladder 96 extend from the gate 37. Pads 126 (FIG. 3) are provided on the portion 124 for the ladder sides to rest on.

The rear walls 34 of the stern portions 30 slope upwardly and forwardly from their rearmost edges. A hand rail 120 is provided adjacent to the rearward edge and up each wall 34 along the sides of the passageway 25. This rail facilitates reboarding from the water as well as from a dock. Also, recessed areas 122 are formed in each wall 34 where dockside electrical and plumbing hook-ups can be provided.

It is noted that in the preferred embodiment the passageway 25 extends behind the stern drive lower units 21. As such, the boat can be easily backed up to a dock, the gate 37 lowered into the open position, and passengers can walk over the gate 37 onto the boat. Also, for reboarding from the water, the lower units are well out of the way to not provide obstructions which can interfere with reboarding.

It will be apparent to those of ordinary skill in the art that many modifications to the preferred embodiment are possible but which would still be within the spirit and scope of the invention. Hence, it is not intended that the invention be limited to the scope of the preferred embodiment, but that it be defined by the claims which follow.

We claim:

1. A hull for a boat, comprising:

a lower hull having a bottom below a static waterline and freeboard sides above the waterline;

an aft passenger cockpit having a floor above the waterline;

a lower stern extending across the rear of the lower hull at least partially below the waterline of the boat and joined with the bottom and freeboard sides;

an upper stern extending aft of the lower stern at least partially above the waterline, said upper stern defining a passageway therethrough from the passenger cockpit to aft of the hull, said passageway having a lower forward area;

a gate aft of the passenger cockpit in the passageway; and hinge means for connecting the gate to the boat to pivot about a horizontal axis;

wherein the gate is pivotable from an open position in which it is folded down substantially flush with the cockpit floor in which position the gate provides access to the cockpit from aft of the hull to a closed position in which the gate is folded up to close off the passageway and form an inside wall of the passenger cockpit;

wherein the gate is hinged to the hull in the lower forward area of the passageway so that the gate pivots toward the front of the boat from the open position to the closed position.

2. A hull for a boat, comprising:

a lower hull having a bottom below a static waterline and freeboard sides above the waterline;

an aft passenger cockpit having a floor above the waterline;

a lower stern extending across the rear of the lower hull at least partially below the waterline of the boat and joined with the bottom and freeboard sides;

an upper stern extending aft of the lower stern at least partially above the waterline, said upper stern defining a passageway therethrough from the passenger cockpit to aft of the hull, said passageway having a lower forward area;

a gate aft of the passenger cockpit in the passageway; and hinge means for connecting the gate to the boat to pivot about a horizontal axis;

wherein the gate is pivotable from an open position in which it is folded down substantially flush with the cockpit floor in which position the gate provides access to the cockpit from aft of the hull to a closed position in which the gate is folded up to close off the passageway and form an inside wall of the passenger cockpit;

further comprising means for damping pivotal movements of the gate; and wherein the damping means comprises at least one gas cylinder.

3. A hull for a boat, comprising:

a lower hull having a bottom below a static waterline and freeboard sides above the waterline;

an aft passenger cockpit having a floor above the waterline;

a lower stern extending across the rear of the lower hull at least partially below the waterline of the boat and joined with the bottom and freeboard sides;

an upper stern extending aft of the lower stern at least partially above the waterline, said upper stern defining a passageway therethrough from the passenger cockpit to aft of the hull, said passageway having a lower forward area;

a gate aft of the passenger cockpit in the passageway; and hinge means for connecting the gate to the boat to pivot about a horizontal axis;

wherein the gate is pivotable from an open position in which it is folded down substantially flush with the cockpit floor in which position the gate provides access to the cockpit from aft of the hull to a closed position in which the gate is folded up to close off the passageway and form an inside wall of the passenger cockpit;

further comprising means for damping pivotal movements of the gate; and wherein:

at least one substantially vertical wall flanks a longitudinal side of the passageway, said wall having a first side which borders the passageway and a second side opposite from the first side;

the hinge means extends through the wall; and the damping means are connected to the hinge means on the second side of the wall.

4. A hull as in claim 3, wherein:

a lever arm extends from the hinge means on the second side of the wall; and the damping means includes a gas cylinder connected to the lever arm.

5. A hull for a boat, comprising:

a lower hull having a bottom below a static waterline and freeboard sides above the waterline;

an aft passenger cockpit having a floor above the waterline;

a lower stern extending across the rear of the lower hull at least partially below the waterline of the boat and joined with the bottom and freeboard sides;

an upper stern extending aft of the lower stern at least partially above the waterline, said upper stern defining a passageway therethrough from the passenger cockpit to aft of the hull, said passageway having a lower forward area;

a gate aft of the passenger cockpit in the passageway; and hinge means for connecting the gate to the boat to pivot about a horizontal axis;

wherein the gate is pivotable from an open position in which it is folded down substantially flush with the cockpit floor in which position the gate provides access to the cockpit from aft of the hull to a closed position in which the gate is folded up to close off the passageway and form an inside wall of the passenger cockpit; and further comprising means for locking the gate in the closed position and sensor means for indicating whether the gate is securely locked;

wherein the sensor means comprises a first detector to detect the position of the locking means and a second detector to sense the position of the gate.

6. A hull for a boat, comprising:

a lower hull having a bottom below a static waterline and freeboard sides above the waterline;

an aft passenger cockpit having a floor above the waterline;

a lower stern extending across the rear of the lower hull at least partially below the waterline adjoined with the bottom and freeboard sides;

an upper stern extending aft of the lower stern at least partially above the waterline, said upper stern defining a passageway therethrough from the passenger cockpit to aft of the hull;

a gate aft of the passenger cockpit in the passageway, said gate defining a compartment; and means for hingedly connecting the gate to the boat to pivot about a horizontal axis;

wherein the gate is pivotable from an open position in which it is folded down in a horizontal position in which position the gate provides access to the cockpit from aft of the hull to a closed position in which the gate is folded up to close off the passageway and form an inside wall of the passenger cockpit;

a door closing off the compartment, said door being hingedly connected to the gate to open with the gate in the open position; and a ladder connected to the gate, said ladder being stored inside the compartment and deployable into the water.

7. A hull as in claim 6, wherein the ladder is pivotally connected to the gate and comprises a plurality of rungs pivotally connected to one another to fold one within another and fit in the compartment.

8. A hull as in claim 7, further comprising means for limiting the rotation of at least one of the lower rungs relative to the next higher rung to prevent the ladder from folding away from a user.

9. A hull as in claim 6, wherein the passageway has a lower forward area and the gate is hinged to the hull in said lower forward area so that the gate pivots toward the front of the boat from the open position to the closed position.

10. A hull as in claim 6, further comprising means for damping pivotal movements of the gate.

11. A hull as in claim 10, wherein the damping means comprises at least one gas cylinder.

12. A hull as in claim 10, wherein:

at least one substantially vertical wall flanks a longitudinal side of the passageway, said wall having a first side which borders the passageway and a second side opposite from the first side;

the hinge means extend through the wall; and the damping means are connected to the hinge means on the second side of the wall.

13. A hull as in claim 12, wherein:

a lever arm extends from the hinge means on the second side of the wall; and the damping means includes a gas cylinder connected to the lever arm.

14. A hull as in claim 6, further comprising means for locking the gate in the closed position and sensor means for indicating whether the gate is securely locked.

15. A hull as in claim 14, wherein the sensor means comprises a first detector to sense the position of the locking means and a second detector to sense the position of the gate.

16. A hull as in claim 6, wherein at least one stern drive lower unit extends from the lower stern and the passageway in the upper stern extends aft of the lower unit.

17. A hull for a boat, comprising:

a lower hull having a bottom below a static waterline and freeboard sides above the waterline;

an aft passenger cockpit having a floor above the waterline;

a transom extending across the rear of the lower hull at least partially below the waterline and joined with the bottom and freeboard sides;

an upper stern above the transom extending aft of the transom, said upper stern comprising:

port and starboard side portions, each said portion being defined by a forward wall, a side wall, a rear wall and the adjacent freeboard side;

wherein the side walls of said portions are spaced apart to define a passageway therebetween;

a gate aft of the passenger cockpit in the passageway; and hinge means for connecting the gate to the boat to pivot about a horizontal axis;

wherein the gate is pivotable from an open position in which it is folded down substantially flush with the cockpit floor where the gate provides access to the cockpit from aft of the hull to a closed position in which the gate is folded up to close off the passageway where the gate forms an inside wall of the passenger cockpit; and wherein the gate defines a compartment and further comprising:

a door closing off the compartment, said door being hingedly connected to the gate to open when the gate is in the open position; and a ladder connected to the gate, said ladder being stored inside the compartment and deployable into the water.

18. A hull as in claim 17, wherein the ladder is pivotally connected to the gate and comprises a plurality of rungs pivotally connected to one another to fold one within another and fit in the compartment.

19. A hull as in claim 18, further comprising means for limiting the rotation of at least one of the lower rungs relative to the next higher rung to prevent the ladder from folding away from a user.

20. A hull for a boat, comprising:

a lower hull having a bottom below a static waterline and freeboard sides above the waterline;

an aft passenger cockpit having a floor above the waterline;

a transom extending across the rear of the lower hull at least partially below the waterline and joined with the bottom and freeboard sides;

an upper stern above the transom extending aft of the transom, said upper stern comprising:

port and starboard side portions, each said portion being defined by a forward wall, a side wall, a rear wall and the adjacent freeboard side;

wherein the side walls of said portions are spaced apart to define a passageway therebetween;

a gate aft of the passenger cockpit in the passageway; and hinge means for connecting the gate to the boat to pivot about a horizontal axis;

wherein the gate is pivotable from an open position in which it is folded down substantially flush with the cockpit floor where the gate provides access to the cockpit from aft of the hull to a closed position in which the gate is folded up to close off the passageway where the gate forms an inside wall of the passenger cockpit; and wherein the passageway has a lower forward area and the gate is hinged to the hull in said lower forward area so that the gate pivots toward the front of the boat from the open position to the closed position.

21. A hull for a boat, comprising:

a lower hull having a bottom below a static waterline and freeboard sides above the waterline;

an aft passenger cockpit having a floor above the waterline;

a transom extending across the rear of the lower hull at least partially below the waterline and joined with the bottom and freeboard sides;

an upper stern above the transom extending aft of the transom, said upper stern comprising:

port and starboard side portions, each said portion being defined by a forward wall, a side wall, a rear wall and the adjacent freeboard side;

wherein the side walls of said portions are spaced apart to define a passageway therebetween;

a gate aft of the passenger cockpit in the passageway; and hinge means for connecting the gate to the boat to pivot about a horizontal axis;

wherein the gate is pivotable from an open position in which it is folded down substantially flush with the cockpit floor where the gate provides access to the cockpit from aft of the hull to a closed position in which the gate is folded up to close off the passageway where the gate forms an inside wall of the passenger cockpit; and further comprising means for damping pivotal movements of the gate; and wherein the damping means comprises at least one gas cylinder.

22. A hull for a boat, comprising:

a lower hull having a bottom below a static waterline and freeboard sides above the waterline;

an aft passenger cockpit having a floor above the waterline;

a transom extending across the rear of the lower hull at least partially below the waterline and joined with the bottom and freeboard sides;

an upper stern above the transom extending aft of the transom, said upper stern comprising:

port and starboard side portions, each said portion being defined by a forward wall, a side wall, a rear wall and the adjacent freeboard side;

wherein the side walls of said portions are spaced apart to define a passageway therebetween;

a gate aft of the passenger cockpit in the passageway; and hinge means for connecting the gate to the boat to pivot about a horizontal axis;

wherein the gate is pivotable from an open position in which it is folded down substantially flush with the cockpit floor where the gate provides access to the cockpit from aft of the hull to a closed position in which the gate is folded up to close off the passageway where the gate forms an inside wall of the passenger cockpit; and further comprising means for damping pivotal movements of the gate; and wherein:

the hinge means extends through the side walls of the port and starboard side portions; and the damping means are inside at least one of the side portions.

23. A hull as in claim 22, wherein:

a lever arm extends from the hinge means inside at least one of the side portions; and the damping means includes a gas cylinder connected to the lever arm.

24. A hull for a boat, comprising:

a lower hull having a bottom below a static waterline and freeboard sides above the waterline;

an aft passenger cockpit having a floor above the waterline;

a transom extending across the rear of the lower hull at least partially below the waterline and joined with the bottom and freeboard sides;

an upper stern above the transom extending aft of the transom, said upper stern comprising:

port and starboard side portions, each said portion being defined by a forward wall, a side wall, a rear wall and the adjacent freeboard side;

wherein the side walls of said portions are spaced apart to define a passageway therebetween;

a gate aft of the passenger cockpit in the passageway; and hinge means for connecting the gate to the boat to pivot about a horizontal axis;

wherein the gate is pivotable from an open position in which it is folded down substantially flush with the cockpit floor where the gate provides access to the cockpit from aft of the hull to a closed position in which the gate is folded up to close off the passageway where the gate forms an inside wall of the passenger cockpit; and further comprising:

means for locking the gate in the closed position; and sensor means for indicating whether the gate is securely locked, said sensor means comprising a first detector to sense the position of the locking means and a second detector to sense the position of the gate.

25. A hull for a boat, comprising:

a lower hull having a bottom below a static waterline and freeboard sides above the waterline;

an aft passenger cockpit having a floor above the waterline;

a transom extending across the rear of the lower hull at least partially below the waterline and joined with the bottom and freeboard sides;

an upper stern above the transom extending aft of the transom, said upper stern comprising:

port and starboard side portions, each said portion being defined by a forward wall, a side wall, a rear wall and the adjacent freeboard side;

wherein the side walls of said portions are spaced apart to define a passageway therebetween;

a gate aft of the passenger cockpit in the passageway; and hinge means for connecting the gate to the boat to pivot about a horizontal axis;

wherein the gate is pivotable from an open position in which it is folded down substantially flush with the cockpit floor where the gate provides access to the cockpit from aft of the hull to a closed position in which the gate is folded up to close off the passageway where the gate forms an inside wall of the passenger cockpit; and wherein the rear wall of each side portion slants forwardly and a hand rail is provided up each rear wall adjacent to the passageway.

* * * * *